United States Patent [19]

Omori

[11] Patent Number: 5,027,501

[45] Date of Patent: Jul. 2, 1991

[54] APPARATUS FOR ATTACHING BOTTOM STOP TO SLIDE FASTENER CHAIN

[75] Inventor: Shigenori Omori, Toyama, Japan

[73] Assignee: Yoshida Kogyo K. K., Tokyo, Japan

[21] Appl. No.: 571,718

[22] Filed: Aug. 24, 1990

[30] Foreign Application Priority Data

Jul. 31, 1989 [JP] Japan ..... 1-225064

[51] Int. Cl.[5] ..... A41H 37/06

[52] U.S. Cl. ..... 29/767; 29/408

[58] Field of Search ..... 29/408, 766, 767, 33.2

[56] References Cited

U.S. PATENT DOCUMENTS 4,433,478 2/1984 Oyama ..... 29/767

4,561,161 12/1985 Morita ..... 29/767

FOREIGN PATENT DOCUMENTS 2022684 12/1979 United Kingdom ..... 29/767

*Primary Examiner*—P. W. Echols

*Attorney, Agent, or Firm*—Hill, Van Santen, Steadman & Simpson

[57] ABSTRACT

An apparatus for attaching bottom stops of a generally H-shaped cross section to a slide fastener chain. According to a preferred embodiment, a pair of stringer tapes of one of successive spaced element-free space sections are spread apart by a spreading member. The top and bottom faces of the center base of the bottom stop are clamped resiliently by clamping members until attaching of the bottom stop to the fastener chain is finished and the clamping members move vertically for placing the bottom stop between the stringer tapes of the space section. The spread pair of stringer tapes are then drawn near to come toward each other by a drawing member until the beaded edges of the space section can be threaded respectively through spaces formed between the pair of gripping legs of the bottom stop. Then the fastener chain is transported so that the bottom stop is located to be contacted with the space section-side face of the terminal element of the row of coupling elements. Finally, the gripping legs of the bottom stop are bent with a punch and a die for attaching the bottom stop to the fastener chain. In the present invention, since clamping operation is carried out so as not to interfere with the bending operation, the bottom stop can be attached to the slide fastener chain surely and precisely.

4 Claims, 7 Drawing Sheets

APPARATUS FOR ATTACHING BOTTOM STOP TO SLIDE FASTENER CHAIN

BACKGROUND OF THE INVENTION

1. Field of the Invention

The present invention relates to an apparatus for attaching bottom stops to an elongate continuous slide fastener chain having longitudinally spaced element-free space sections between the rows of coupling elements so as to be contacted with the space section-side face of each terminal element of the row of the coupling elements.

2. Prior Art

As shown in Japanese Patent Publication No. 57-60003 and U.S. Pat. No. 4433478, it is known to attach bottom stops having two pairs of gripping legs on opposite sides to be of a substantially H-shaped cross section to a slide fastener chain, which has longitudinally spaced element-free space sections between the rows of coupling elements; one bottom stop is attached to the fastener chain so as to be contacted with the space section-side face of the terminal element of the row of the coupling elements and is mounted on a pair of stringer tapes along beaded edges thereof.

In the above mentioned prior art, the bottom stop is attached to the slide fastener chain in the following manner. The slide fastener chain is transported intermittently so that the space section is brought to terminate at a fixed area, which is detected by well known sensing means. Next, the bottom stop is placed between the stringer tapes of the space section, which have been spread apart by means of a spreading means. Then, while the pair of beaded edges are threaded through spaces which are formed respectively between the upper and lower gripping legs of the bottom stop, the slide fastener chain is transported until the terminal element of one of the rows of coupling elements reaches the bottom stop. Finally, the opposed pairs of gripping legs of the bottom stop are caulked with a punch and a die. Thereby the bottom stop is attached to the slide fastener chain so as to be contacted with the space section-side face of the terminal element of the row of coupling elements.

The bottom stop, which connects the beaded edges and which is contacted with the space section-side face of the terminal element of the row of coupling elements, should be attached surely to the fastener chain so as to keep the predetermined transverse distance between the pair of stringer tapes and so as to keep a precise position even when an external force is applied to the bottom stop, for example, when a slider is moved to contact with the bottom stop.

However, in each above mentioned conventional apparatus of attaching bottom stops, there is a following problem. The bottom stop is supported by the punch or the die with a placing and retaining means. This means is released when caulking operation is started by the punch and the die. Accordingly, during this caulking operation, the bottom stop often can not keep the precise position in relation with the beaded edges, or can not keep a precise attaching direction due to a pulling force from the end of the space section. As a result, the bottom stop can not be attached with accuracy, further the attaching force is insufficient.

SUMMARY OF THE INVENTION

It is therefore a main object of the present invention to provide an apparatus of attaching bottom stops having two pairs of gripping legs at their opposite sides to a slide fastener chain so that each bottom stop is mounted on a pair of beaded edges to be contacted with the space section-side face of the terminal element of the successive spaced pairs of the rows of coupling elements by clamping the bottom stop from the top and bottom faces of the center base thereof until attaching of the bottom stop to the slide fastener is finished and by locating the bottom stop at a precise position on a feed path of the fastener chain for caulking the gripping legs of the bottom stops surely and precisely with a punch and a die.

According to the present invention, an apparatus for attaching bottom stops to a slide fastener chain is provided. In the present invention, the fastener chain has a pair of stringer tapes supporting a pair of intermeshing rows of coupling elements on respective longitudinal beaded edges thereof. Further, element-free space sections are spaced longitudinally between the rows of coupling elements. Each bottom stop has two pairs of gripping legs at its opposite sides.

This apparatus comprises means for transporting the slide fastener chain longitudinally along a feed path in a predetermined direction, means for terminating the transportating of the fastener chain after the arrival of one space section at a fixed area, means responsive to the arrival of the space section to the fixed area for spreading the space section and placing the bottom stop between the pair of stringer tapes of the space section, a combination of an upper apparatus and a die, which are placed above and below the space section at the fixed area respectively and means for transporting the fastener chain to locate the bottom stop to be contacted with the space section-side face of the terminal element of the row of coupling elements.

The upper apparatus has means for supplying the bottom stops, whose outlet is provided above the fixed area and from which the most proceeding bottom stop is fed out, while the bottom stop keeps a position so that the pair of beaded edges are threaded through spaces which are formed respectively between the upper and lower gripping legs of the bottom stop. Also, the upper apparatus has means for clamping the bottom stop, which receives the bottom stop from the means for supplying the bottom stops, which clamps resiliently the bottom stop from the top and bottom faces of the center base thereof until attaching of the bottom stop to the fastener chain is finished, which is brought down to the space section after spreading the stringer tapes of the space section by the means for spreading the space section and which is brought up to be returned to an original position after the attaching of the bottom stop to the fastener chain. The upper apparatus is provided with also a punch for caulking the gripping legs of the bottom stop, which is disposed transversely at the both sides of the means for clamping the bottom stop, which is disposed to be faced the top faces of the opposed pairs of gripping legs of the bottom stop and which is operated responsive to the clamping of the bottom stop.

The die for caulking the gripping legs of the bottom stop with the punch, which has a room allowing the means for clamping the bottom stop to be inserted thereinto, which is disposed to be faced the bottom faces of the opposed pairs of gripping legs of the bottom stop and which moves vertically.

In the present invention, since clamping operation is carried out so as not to interfere with caulking operation, the bottom stop can be attached to the slide fastener chain surely and precisely.

Further objects and advantages of the present invention will be apparent from the following description, reference being had to the accompanying drawing wherein preferred embodiments of the present invention are clearly shown.

BRIEF DESCRIPTION OF THE DRAWINGS

The drawings show an embodiment of the present invention.

DESCRIPTION OF THE PREFERRED EMBODIMENT

Figure 1:
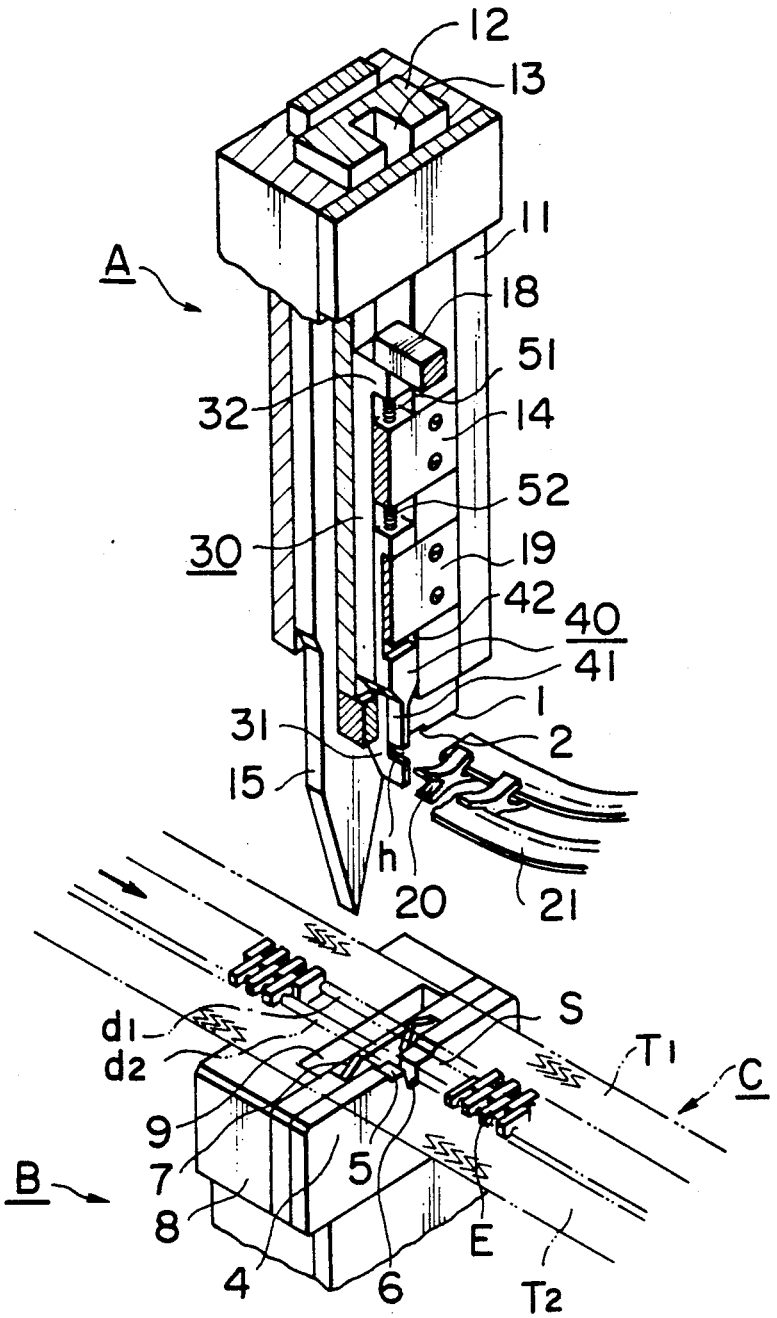
FIG. 1 is a perspective view of an important part of an apparatus of attaching bottom stops, partly in cross section and partly broken away.

Now, the present invention is described referring to the drawings.

In FIG. 1, a slide fastener chain C is transported from left to right on a feed path formed on a substantially horizontal line by means for transporting the fastener chain C. The fastener chain C has a pair of stringer tapes $T_1$, $T_2$ supporting a pair of intermeshing rows E of coupling elements on respective longitudinal beaded edges $d_1$, $d_2$ thereof. Further, element-free space sections S are spaced longitudinally between the rows E of coupling elements.

Now, a proceeding side as viewed from the transported direction of the slide fastener chain C will be expressed as a downstream side. Then, a following side will be expressed as an upstream side.

The apparatus of attaching the bottom stops 20 is composed of an upper apparatus A, which is placed above the feed path for the fastener chain C, and a lower apparatus, B, which is placed below the feed path.

In the upper apparatus A, a casing 11, which is fixed to a frame 10, includes a movable block 12, which has a longitudinal trough 13 on its downstream side, and a spreading member 15 as means for spreading the space section S, which has a tapered tip end at its lower end and which is placed at the upstream side in relation to the movable block 12. Then, the movable block 12 and the spreading member 15 can be slid vertically. In the trough 13, lower and upper clamping members 30, 40 as means for clamping the bottom stop 20 are provided to be slid vertically for clamping the bottom stop 20. The lower clamping member 30 is placed to be contacted with the inner downstream side face of the trough 13. The upper clamping member 40 is placed to be contacted with the downstream side face of the lower clamping member 30. Then, the clamping members 30, 40 can be slid separately in a vertical direction.

The lower clamping member 30 is provided at its bottom with a thin lower clamping claw 31, whose bottom is projected toward downstream side to be L-shaped. Then, the lower clamping member 30 is provided at its top with a projection 32, which is projected toward understream side. The lower clamping member 30 is supported by a cross rack 14, which is fixed transversely on the trough 13 of the movable block 12 at the inner downstream side face of the trough 13 right below the projection 32. The upper clamping member 40 is provided with a thin upper clamping claw 41 at its bottom and is provided with a notch 42 on the center part of its downstream side face. The upper clamping member 40 is supported by a lower limit stopper 19, which is fixed transversely on the trough 13 of the movable block 12 to be contacted with the inner downstream side face of the notch 42. Accordingly, a space h, which is formed between the bottom face of the upper clamping claw 41 and the top face of the L-shaped lower clamping claw 31, serves as a space for clamping one bottom stop.

An upper limit stopper 18 is provided in the casing 11 so that the lower clamping member 30 can not be brought up over the upper limit stopper 18. A compression coil spring 51 is connected between the bottom face of the projection 32 of the lower clamping member 30 and the top face of the cross rack 14. A compression coil spring 52 is connected between the bottom face of the cross rack 14 and the top face of the upper clamping member 40.

Figure 8:
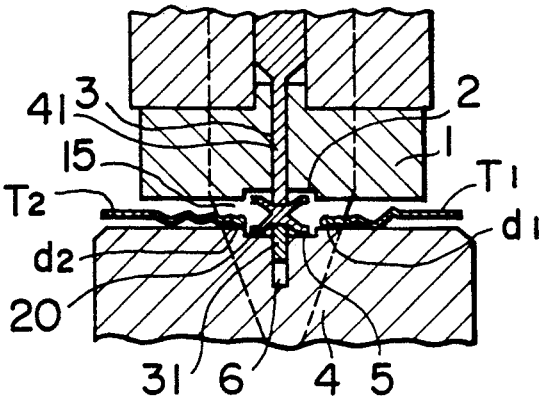
FIGS. 8, 9 and 10 are elevational views in section showing inserting operation into a space between a pair of stringer tapes and caulking operation for the gripping legs of a bottom stop with a punch and a die.

As shown in FIGS. 1 and 8, a punch 1 fixed at the bottom of the movable block 12 has a vertical guide trough 13, whose downstream side is opened, for guiding the lower clamping claw 31 and the upper clamping claw 41. Then, the punch 1 has a pressuring concave 2, which is provided transversely at the bottom of the guide trough 13 and which is brought into contact with the top faces of the opposite pairs of gripping legs of the bottom stop 20.

Figure 2:
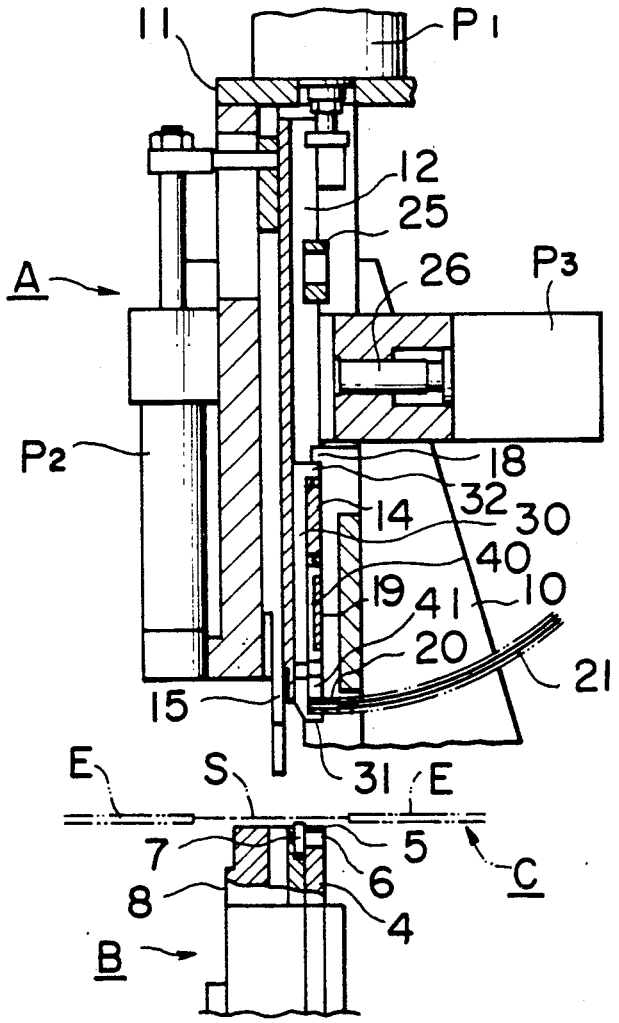
FIGS. 2 and 3 are side views of an apparatus of attaching bottom stops by which different operations are carried out respectively, partly in cross section.
Figure 3:
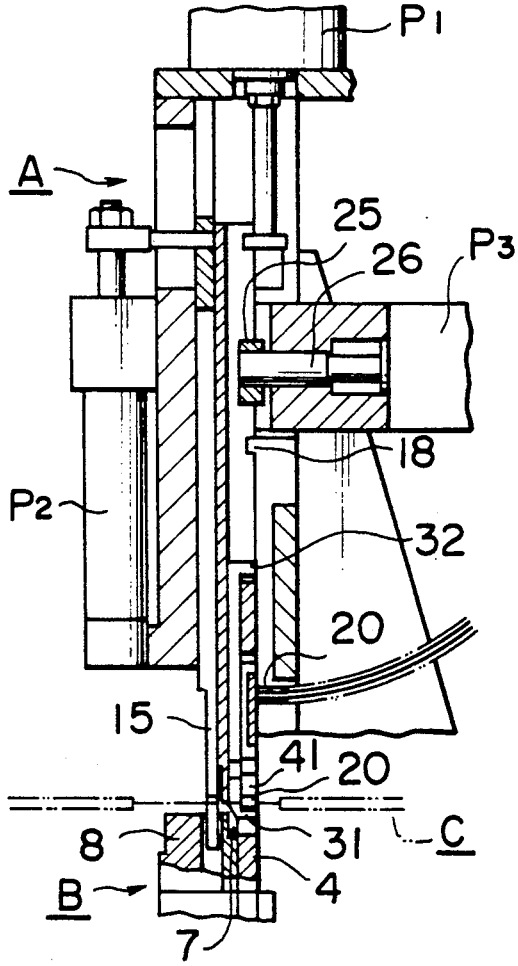

As shown in FIGS. 2 and 3, an air cylinder $P_1$ is mounted on the casing 11 for driving vertically the movable block 12, an air cylinder $P_2$ is fixed at the upstream side of the casing 11 for driving vertically the spreading member 15 and an air cylinder $P_3$ is provided at the downstream side of the movable block 12 so that an engaging rod 26 connected to the upstream side face of the air cylinder $P_3$ can be pushed into and be engaged with an engaged member 25 fixed on the downstream side face of the movable block 12, when the movable block 12 is brought down to the lowest position as shown in FIG. 3.

FIGS. 1 and 2 show that the movable block 12 is brought up to the highest position by means of the air cylinder $P_1$. Therefore, the projection 32 of the lower clamping member 30 stops at the upper limit stopper 18 so that the lower clamping member 30 can be engaged at a predetermined position and the upper clamping member 40 engages to the lower limit stopper 19 by means of the compression coil spring 52. Then, the lower clamping claw 31 and the upper clamping claw 41 are projected downward from the pressuring concave 2 respectively. As a result, the space h, whose downstream side is opened and which has a predetermined size, can be formed between the clamping claws 31, 41.

The bottom stop 20 is a metal article having the two pairs of upper and lower gripping legs projected from its center base at its opposite sides to be of a substantially H-shaped cross section. The both ends of the pairs of the gripping legs are slightly departed away from each other. A chute 21 is provided as means for supplying the bottom stops 20. A number of bottom stops 20 go through the chute 21 while they are engaged to it. The outlet of the chute 21 is placed so that the center base of the bottom stop 20 is fit and engaged in the space h formed between the upper and lower clamping claws 31, 41. Then, a most proceeding bottom stop 20 is fed to the space h by a suitable means. Accordingly, the predetermined length of the space h is preferably slightly longer than the thickness of the center base of the bottom stop 20 in order that the bottom stop 20 can be received easily and can be pushed into a secured position in the space h. Therefore, the upper limit stopper 18 is preferably placed so as to be moved vertically in relation to the casing 11 for adjusting the length of the space h properly.

The lower apparatus B is opposed to the upper apparatus A with respect to the fastener chain C and has a die 4, a drawing member 7 as means for drawing the beaded edges $d_1$, $d_2$, which is placed to be contacted with the upstream side face of the die 4, and a supporting bed 8, which is placed to be contacted with the upstream side face of the drawing member 7 and which has transversely a receiving groove 9 for allowing the spreading member 15 to be inserted thereinto. The top face of the lower apparatus B is located right below the fastener chain C. The lower apparatus B is supported by an air cylinder (not shown) so as to move the die 4, the supporting bed 8 and the drawing member 7 together in a vertical direction a small distance. The die 4 is further supported by another air cylinder (not shown) so as to be moved vertically. Therefore, a vertical movement of only the die 4 which is separate from the movement of the whole lower apparatus B can be obtained.

A pressuring concave 5 is formed transversely on the center part of the top face of the die 4 so as to be contacted with the bottom faces of the pairs of the gripping legs of the bottom stop 20. Further an engaging groove 6 as a room allowing the lower clamping claw 31 to be inserted thereinto is formed at the center of the bottom face of the pressuring concave 5 so as to communicate with the concave 5.

Figure 11:
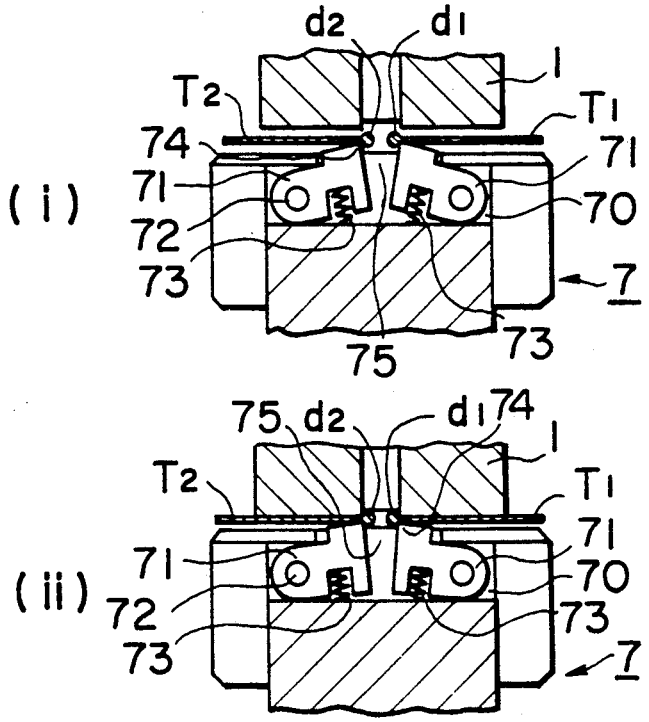
FIG. 11 is an elevational view in section showing operation of a drawing member.

As shown in FIG. 1, the drawing member 7 is placed to be contacted with the upstream side face of the die 4. As shown in FIG. 11, a receiving concave 70 is formed on the downstream side face of the upper part of the supporting bed 8. A pair of opposed drawing tips 71, 71, which draw the pair of beaded edges $d_1$, $d_2$ to come toward each other, are pivotably supported by the bed 8 about axes 72, 72 in the receiving concave 70. Upper corners 74, 74 of the drawing tips 71, 71 are projected slightly from an opening 75 by means of springs 73, 73 respectively. As shown in FIG. 11 (i), when the supporting bed 8 is brought up by the air cylinder and the punch 1 is brought down to a lowest position, the pair of upper corners 74, 74 are brought into contact with a pair of beaded edges $d_1$, $d_2$ from their underside between the tape $T_1$ and the beaded edge $d_1$ and between the tape $T_2$ and the beaded edge $d_2$ respectively. Then, as shown in FIG. 11 (ii), while the pair of beaded edges $d_1$, $d_2$ are held between the underside of the punch 1 and the pair of upper corners 74, 74, the pair of drawing tips 71, 71 are pivoted downward. Therefore, the beaded edges $d_1$, $d_2$ are drawn near to come toward each other by the upper corners 74, 74. Accordingly, while the center base of the bottom stop 20 is clamped by the above mentioned clamping claws 31, 41, the beaded edges $d_1$, $d_2$ can be pushed into the spaces formed between the opposed two pairs of upper and lower gripping legs of the bottom stop 20 easily.

Figure 7:
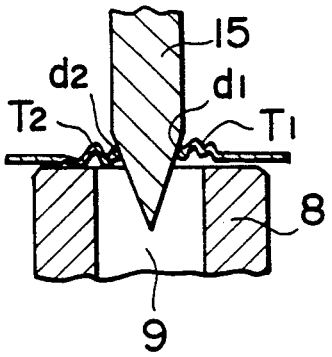
FIG. 7 is an elevational view in section showing operation of a spreading member.

As shown in FIG. 1, the groove 9, which allows the spreading member 15 to be inserted thereinto, is formed transversely on the center part of the top face of the supporting bed 8 and is disposed to be contacted with the upstream side face of the drawing member 7. As shown in FIG. 7, the spreading member 15 is inserted through the space section S of the fastener chain C placed right above the supporting bed 8. Then the tapered tip end of the spreading member 15 can be inserted into the groove 9 of the supporting bed 8. Thereby, the opposed stringer tapes $T_1$, $T_2$ are crumpled so as to be spread from each other. During this spreading operation of the tapes $T_1$, $T_2$, the tapes $T_1$, $T_2$ are supported on the flat parts of the top faces of the supporting bed 8 and the drawing member 7, which are placed right below the tapes $T_1$, $T_2$ at upstream and downstream side faces of the receiving groove 9 respectively. Accordingly, crumpling in a downward direction of the stringer tapes $T_1$, $T_2$ caused from inserting of the spreading member 15 can be decreased so that the beaded edges $d_1$, $d_2$ can be surely pushed into the spaces formed between the two pairs of gripping legs of the bottom stop 20 respectively.

Now, operation of the bottom stop attaching apparatus of the present invention of the type described above will be explained.

The first step for setting the fastener chain C is shown in FIGS. 1 and 2. The movable block 12 and the spreading member 15 of the upper apparatus A are brought up to the highest position by means of the air cylinders $P_1$, $P_2$. The most proceeding bottom stop 20 is fed out from the chute 21 and stays at the outlet of the chute 21. The outlet is adjacent to the space h formed between the upper clamping claw 41 and the lower clamping claw 31. In this case, the top face of the lower apparatus B locates right below the feed path for the fastener chain C. Then, the fastener chain C is transported along the feed path until the space section S of the fastener chain C reaches the fixed area or the substantial of the space section S reaches the operation area for the spreading member 15, which is detected by a sensing means (not shown). That is to say, after the arrival of the space section S at the fixed area, the fastener chain C is stopped by means for terminating the transportation of the fastener chain C. In this case, the downstream side end of the space section S locates at the downstream side of the operation area of the punch 1 and the die 4.

Next, the second step for fixing the vertical position of the bottom stop 20 is shown in FIG. 3. The spreading member 15 is brought down by means of the air cylinder $P_2$ so that its tapered tip end is inserted between the beaded edges $d_1$, $d_2$ of the space section S so as to spread a space formed between the tapes $T_1$, $T_2$. At the same time, the movable block 12 is brought down to the lowest position by means of the air cylinder $P_1$. On the other hand, after the downward movement of the movable block 12 was started, the center base of the most proceeding bottom stop 20 has been clamped resiliently between the upper clamping claw 41 and the lower clamping claw 31 by means of the resilient forces of the compression coil springs 51, 52. Accordingly, the center base of the bottom stop 20 is located at a predetermined vertical position on the feed path between the tapes $T_1$, $T_2$ of the space section S, which are spread to be apart each other. In this case, the air cylinder $P_3$ is operated so that the engaged rod 26 is pushed into and engaged with the engaging member 25 for fixing the movable block 12. As a result, the bottom stop 20 and the punch 1 are retained at the predetermined vertical positions respectively.

Figure 4:
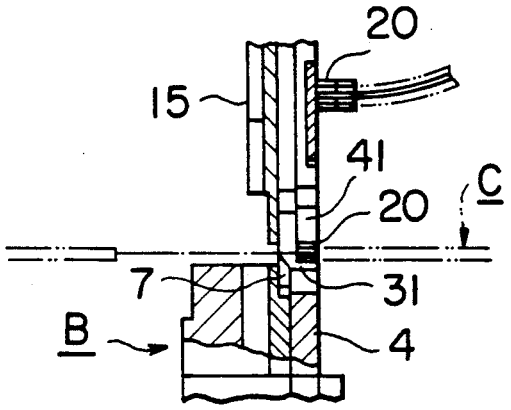
FIGS. 4 and 5 are side views of an important part of an apparatus of attaching bottom stops, partly in cross section by which different operations are carried out respectively.

Then, the third step for locating the bottom stop 20 is shown in FIG. 4. The spreading member 15 is brought up by returning operation of the air cylinder $P_2$. Accordingly, the beaded edges $d_1$, $d_2$ are returned to original positions so as to be pushed into and be threaded through the spaces formed between the two pairs of gripping legs of the bottom stop 20 respectively. Next, the fastener chain C is transported by means for transporting the fastener chain C to locate the downstream side face of the bottom stop 20 to be contacted with the space section-side face of the terminal element of the row E of the coupling elements. In this embodiment, although the fastener chain C is transported in the opposite direction to the normal feeding direction for locating the bottom stop 20 precisely, the fastener chain C might be transported in the feeding direction. In this case, comparing this embodiment shown in FIG. 1, the space h formed between the clamping claws 31, 41 should be opened at its upstream side and the spreading member 15 should be placed at the downstream side of the clamping members 30, 40. Therefore the position of the outlet of the chute 21 is changed corresponding to the position of the space h. Further, the bottom stop 20 is located to be contacted with the space section-side of the most proceeding element of the following row E of the coupling elements.

Figure 5:
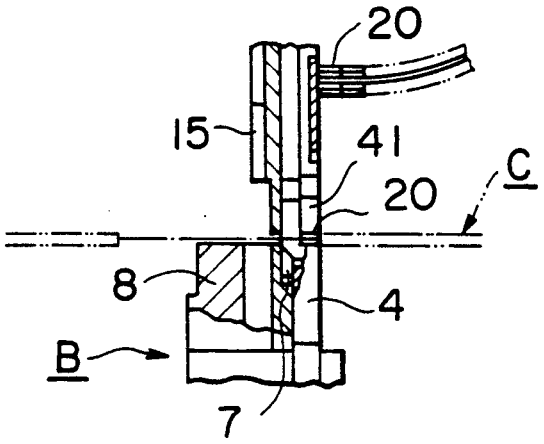

The fourth step for bending the gripping legs of the bottom stop 20 is shown in FIG. 5. As soon as the above mentioned third step is finished, the supporting bed 8 connected by the drawing member 7 of the lower apparatus B is brought up by means of the air cylinder (not shown). That is to say, the top face of the supporting bed 8 is brought up toward the bottom face of the fastener chain C. During this upward movement of the supporting bed 8, the beaded edges $d_1$, $d_2$, which are placed right below the bottom face of the bottom stop 20, are allowed to come toward each other by means of the drawing members 7. Therefore, the beaded edges $d_1$, $d_2$ can be pushed into the spaces formed between the opposed pairs of gripping legs of the bottom stop 20 respectively and easily. Then, the die 4 is brought up by means of the air cylinder. Then, the top and bottom faces of each pair of gripping legs are bent by the punch 1 and the die 4, while the gripping legs clinch about the compressed beaded edges $d_1$, $d_2$. As a result, the opposed stringer tapes $T_1$, $T_2$ are connected to each other by the surely attached bottom stop 20 to be contacted with the space section-side face of the terminal element of the row E of the coupling elements. The attaching operation of the bottom stop 20 is thereby finished.

Finally, in the fifth step for removing the attached bottom stop 20 from the clamping members 30, 40, the whole lower apparatus B is brought down and, simultaneously, the fastener chain C is transported longitudinally along the feed path in the predetermined direction by the means for transporting the fastener chain C. As so doing, the bottom stop 20, which is attached to the fastener chain C, is removed from the resilient clamping members 30, 40. At the same time, the movable block 12 is returned by means of the air cylinder $P_3$. Therefore, the first step for fixing the fastener chain C can be performed again to carry out a next attaching operation of a next bottom stop 20 to the fastener chain C.

Figure 6:
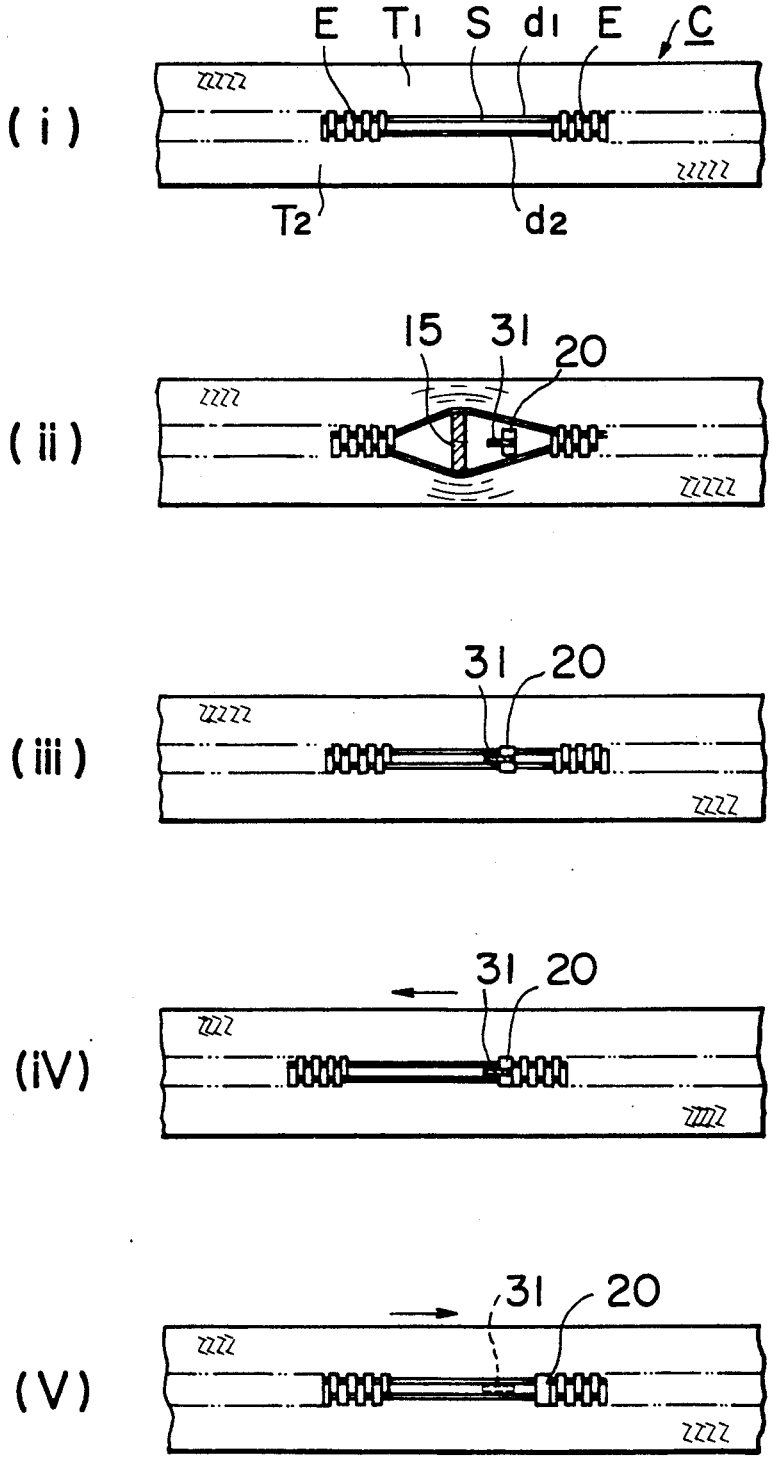
FIG. 6 are schematic plan views showing attaching operation of a bottom stop to a fastener chain.

In FIG. 6, schematic plan views show the operations of the fastener chain C in the above mentioned steps respectively. FIG. 6 (i) shows the first step, by which the fastener chain C is set. FIG. 6 (ii) shows the second step for fixing the vertical position of the bottom stop 20. That is to say, the bottom stop 20, whose center base is clamped between the upper clamping claw 41 and the lower clamping claw 31, is placed between the pair of tapes $T_1$, $T_2$ of the space section S. The tapes $T_1$, $T_2$ are spread to be apart each other by inserting the spreading member 15. FIGS. 6 (iii) and 6 (iv) show the third step for locating the bottom stop 20 to be contacted with the space section-side face of the terminal element of the row E of the coupling elements. As shown in FIG. 6 (iii), since the spreading member 15 is brought up to be returned to the original position, the beaded edges $d_1$, $d_2$ along the stringer tapes $T_1$, $T_2$ of the space section S are allowed to return toward each other and thereby are pushed into the spaces formed between the opposed pairs of gripping legs of the bottom stop 20. Then, as shown in FIG. 6 (iv), the fastener chain C is transported in the direction indicated by the arrow in this figure until the bottom stop 20 is contacted with the space section-side face of terminal element of the row E of coupling elements. At this position, the opposed pairs of gripping legs of the bottom stop 20 are caulked with the punch 1 and the die 4 in the fourth step, although this step is not shown in FIG. 6. FIG. 6 (v) shows the fifth step for removing the bottom stop 20 from the clamping claws 31, 41. In this step, the lower apparatus B is brought down and the fastener chain C, to which the bottom stop 20 is attached, is transported in the direction indicated by the arrow in FIG. 6 (v) as the feeding direction of the fastener chain C. Accordingly, the bottom stop 20 can be removed from the lower and upper clamping claws 31, 41.

Figure 9:
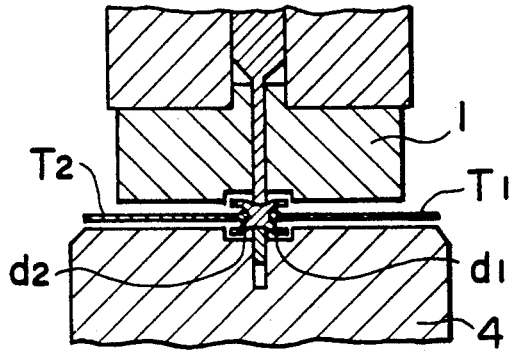
Figure 10:
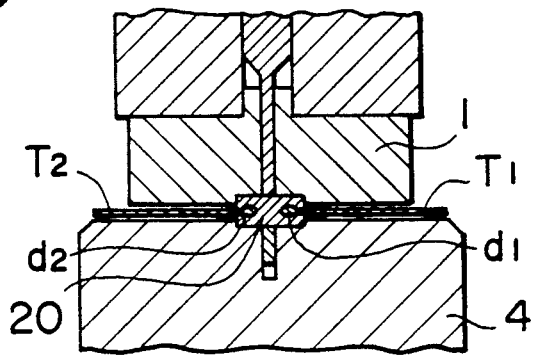

FIGS. 8, 9 and 10 are elevational views in section showing operation of the stringer tapes $T_1$, $T_2$, gripping legs of the bottom stop 20, the punch 1 and the die 4 one by one for attaching the bottom stop 20 to the fastener chain C. FIG. 8 corresponds to finishing of the second step. In this figure, the bottom stop 20 clamped by the clamping claws 31, 41 is placed between the stringer tapes $T_1$, $T_2$ which are crumpled to be spread apart each other by inserting of the spreading member 15. FIG. 9 corresponds to finishing of the third step. In this figure, the bottom stop 20 is located precisely to be contacted with the space section-side face of the terminal element of the row E of the coupling elements and the beaded edges $d_1$, $d_2$ are threaded through the space between the opposed pairs of gripping legs. Finally, FIG. 10 corresponds to finishing of the fourth step. That is to say, the opposed pairs of gripping legs clinch about the beaded edges $d_1$, $d_2$ respectively and are caulked by the punch 1 and the die 4, thus, the bottom stop 20 is attached to the fastener chain C precisely and surely.

It is apparent that the fastener chain C used in the present invention might be any type of known slide fastener chain composed of a pair of intermeshing rows of helically coiled or zigzag coupling elements which are made of metal or synthetic resin.

While preferred embodiments have been described, it is apparent that the present invention is not limited to the specific embodiments thereof.

What is claimed is:

1. An apparatus for attaching bottom stops to an elongate continuous slide fastener chain having a pair of stringer tapes supporting a pair of intermeshing rows of coupling elements on respective longitudinal beaded edges thereof with longitudinally spaced element-free space sections between said rows of coupling elements, each of said bottom stops having two pairs of gripping legs at its opposite sides, said apparatus comprising:

(a) means for transporting said fastener chain longitudinally along a feed path in a predetermined direction;

(b) means for terminating the transportation of said fastener chain after the arrival of one of said space sections at a fixed area;

(c) means responsive to said arrival of said space section to said fixed area of spreading said space section and placing said bottom stop between said pair of stringer tapes of said space section;

(d) a combination of an upper apparatus and a die which are placed above and below said space section at said fixed area respectively;

(d-i) said upper apparatus consisting;

means for supplying said bottom stops, whose outlet is provided above said fixed area and from which the most proceeding bottom stop of said bottom stops is fed out while said bottom stop is in position so that the pair of beaded edges are threaded through spaces which are formed respectively between the upper and lower gripping legs of the bottom stop;

means for clamping said bottom stop, which receives said bottom stop from said means for supplying said bottom stops, which clamps resiliently said bottom stop from the top and bottom faces of a center base thereof until attaching of said bottom stop to said fastener chain is finished, which is brought down to said space section after spreading said pair of stringer tapes of said space section by said means for spreading said space section and which is brought up to be returned to an original position after said attaching of said bottom stop to said fastener chain;

a punch for bending said gripping legs of said bottom stop, which is disposed transversely at the both sides of said means for clamping said bottom stop, which is disposed to face the top faces of said opposed pairs of gripping legs of said bottom stop and which is operated responsive to said clamping of said bottom stop and (d-ii) said die for bending said gripping legs of said bottom stop with said punch, which has a room allowing said means for clamping said bottom stop to be inserted thereinto, which is disposed to face the bottom faces of said opposed pairs of gripping legs of said bottom stop and which moves vertically; and (e) said means for transporting said fastener chain being operable to move said fastener chain to a position permitting said bottom stop to be contacted with a side face at said space section of said terminal element of said row of coupling elements.

2. An apparatus according to claim 1, wherein said means for clamping said bottom stop has a lower clamping claw being urged resiliently in an upward direction and an upper clamping claw being urged resiliently in a downward direction, said upper and lower clamping claws can be moved vertically in a mutual relative connection and a space formed vertically between said clamping claws is set not to be shorter than or not to be the same as a predetermined length.

3. An apparatus according to claim 1, said means for spreading space section is plate-shaped with a tapered tip end at its lower part so as to have a width being perpendicular to said feed path of said fastener chain, is disposed at either side of said means for clamping said bottom stop so as not to substantially interfere with the transportation of said fastener chain for locating said bottom stop to be contacted with said space section-side face of said terminal element of said raw of coupling elements, is brought down responsive to said arrival of said space section to said fixed area for spreading apart transversely said pair of stringer tapes of said space section and is brought up to be returned to an original position after placing of said bottom stop between said pair of stringer tapes of said space section.

4. An apparatus according to claim 1 wherein means for drawing wherein said pair of beaded edges toward each other is provided to be contacted with said die and operates responsive to operation of said upper apparatus.

* * * * *

UNITED STATES PATENT AND TRADEMARK OFFICE

CERTIFICATE OF CORRECTION

PATENT NO. : 5,027,501

DATED : July 2, 1991

INVENTOR(S) : Shigenori Omori

It is certified that error appears in the above—identified patent and that said Letters Patent is hereby corrected as shown below:

On the Title page, item [30], Foreign Application Priority Data should be changed from "Jul. 31, 1989" to --Aug. 31, 1989--.

Signed and Sealed this

Tenth Day of August, 1993

*Attest:*

Michael K. Kirk

MICHAEL K. KIRK

*Attesting Officer*

*Acting Commissioner of Patents and Trademarks*